US012747930B2

(12) United States Patent
Lee et al.

(10) Patent No.: US 12,747,930 B2
(45) Date of Patent: Sep. 29, 2026

(54) FIREARM REPLACEMENT HANDGUARD

(71) Applicant: Strike IP LLC, Las Vegas, NV (US)

(72) Inventors: Shanyao Lee, Las Vegas, NV (US); Chien-Yuan Cheng, Las Vegas, NV (US); Hung-Ju Lee, Las Vegas, NV (US)

(73) Assignee: Strike IP LLC, Las Vegas, NV (US)

( * ) Notice: Subject to any disclaimer, the term of this patent is extended or adjusted under 35 U.S.C. 154(b) by 0 days.

(21) Appl. No.: 19/286,146

(22) Filed: Jul. 30, 2025

(65) Prior Publication Data

US 2026/0036395 A1 Feb. 5, 2026

Related U.S. Application Data

(60) Provisional application No. 63/678,457, filed on Aug. 1, 2024.

(51) Int. Cl.
*F41C 23/16* (2006.01)

(52) U.S. Cl.
CPC ..... *F41C 23/16* (2013.01)

(58) Field of Classification Search
CPC ..... F41C 23/16
See application file for complete search history.

(56) References Cited

U.S. PATENT DOCUMENTS

| | | | | |
|---|---|---|---|---|
| 8,141,289 | B2 * | 3/2012 | Gomez | F41C 23/16 42/90 |
| 8,276,304 | B2 * | 10/2012 | Samson | F41C 23/16 42/72 |
| 8,448,367 | B2 * | 5/2013 | Samson | F41A 13/12 42/75.02 |
| 8,464,457 | B2 * | 6/2013 | Troy | F41C 23/16 42/71.01 |
| 9,212,865 | B2 * | 12/2015 | Dubreuil | F41C 23/16 |
| 9,448,027 | B1 * | 9/2016 | Zinsner | F41A 21/482 |
| 10,935,343 | B2 * | 3/2021 | Chin | F41A 11/00 |
| 12,018,907 | B1 * | 6/2024 | Noonan | F41C 23/16 |
| 2011/0239513 | A1 * | 10/2011 | Sandman | F41C 23/16 29/525.01 |
| 2017/0097207 | A1 * | 4/2017 | Hines | F41C 23/16 |
| 2018/0202759 | A1 * | 7/2018 | Samson | F41A 3/66 |

* cited by examiner

*Primary Examiner* — Michelle Clement
(74) *Attorney, Agent, or Firm* — Andy M. Han; Han IP PLLC

(57) ABSTRACT

A device implementable on a firearm includes a handguard. When the handguard is installed on the firearm: (a) the handguard is configured to surround at least a portion of a barrel of the firearm; (b) the handguard has a first distal end and a second distal end opposite the first distal end such that the first distal end points in a direction of a muzzle of the firearm and the second distal end points toward an upper receiver of the firearm; and (c) the second distal end is configured with physical features that interlock with a star-shaped barrel nut of the firearm to secure the handguard onto the firearm.

16 Claims, 4 Drawing Sheets

FIREARM REPLACEMENT HANDGUARD

CROSS REFERENCE TO RELATED PATENT APPLICATION(S)

The present disclosure claims the priority benefit of U.S. Provisional Patent Application No. 63/678,457, filed 1 Aug. 2024, the content of which herein being incorporated by reference in its entirety.

TECHNICAL FIELD

The present disclosure is generally related to firearm accessories and, more particularly, to a firearm replacement handguard.

BACKGROUND

Unless otherwise indicated herein, approaches described in this section are not prior art to the claims listed below and are not admitted as prior art by inclusion in this section.

Modern firearms such as the AR-15 (as well as its military counterparts, the M4), for example, are typically equipped with polymer handguards. The polymer handguard is secured to the rifle/carbine by two mechanisms, namely: a handguard cap at the front end with a delta ring, a weld spring and a star-shaped barrel nut at the rear end. The delta ring, weld spring and star-shaped barrel nut are secured with the barrel and upper receiver of the firearm. This design can secure the handguard and prevent it from rotation as well as moving back and forth when installed on the firearm.

However, the polymer handguard tends to only provide limited functionality, mainly allowing a user to hold the firearm comfortably and protecting the user's hand/arm from being harmed by the heated barrel during firing of the firearm. Modern military needs require a more robust and versatile handguard with additional mounting functionality. To achieve this goal, aluminum handguards have been introduced. Nevertheless, mounting an aluminum handguard on the AR15/M4 rifle/carbine securely can be challenging. That is, the mounting/installation typically requires the user to change the barrel nut and remove the delta ring and weld spring, resulting in a process that is time consuming and often requires a gunsmith and specialized tools.

Therefore, there is a need for a solution of a firearm replacement handguard.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose innovative designs of a firearm replacement handguard. It is believed that the proposed designs can avoid or otherwise minimize aforementioned issue associated with existing accessories attachment designs. For instance, a handguard under one or more of the schemes proposed herein addresses the aforementioned issue by allowing the use of the original firearm components without the need of removing the star-shaped barrel nut, delta ring or weld spring. Installation and removal of the handguard under one or more of the schemes proposed herein may be relatively quick and easy, without the use of specialized tools.

In one aspect, a device implementable on a firearm (e.g., an AR-15 style firearm) may include a handguard. When the handguard is installed on the firearm: (a) the handguard is configured to surround at least a portion of a barrel of the firearm; (b) the handguard has a first distal end and a second distal end opposite the first distal end such that the first distal end points in a direction of a muzzle of the firearm and the second distal end points toward an upper receiver of the firearm; and (c) the second distal end is configured with physical features that interlock with a star-shaped barrel nut of the firearm to secure the handguard onto the firearm.

In another aspect, an apparatus implementable on a firearm (e.g., an AR-15 style firearm) may include a handguard and at least a portion of the firearm, including a barrel, a star-shaped barrel nut, a delta ring, and an upper receiver. When the handguard is installed on the firearm: (a) the handguard is configured to surround at least a portion of the barrel; (b) the handguard has a first distal end and a second distal end opposite the first distal end such that the first distal end points in a direction of a muzzle of the firearm and the second distal end points toward the upper receiver; and (c) the second distal end is configured with physical features that interlock with a star-shaped barrel nut of the firearm to secure the handguard onto the firearm.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
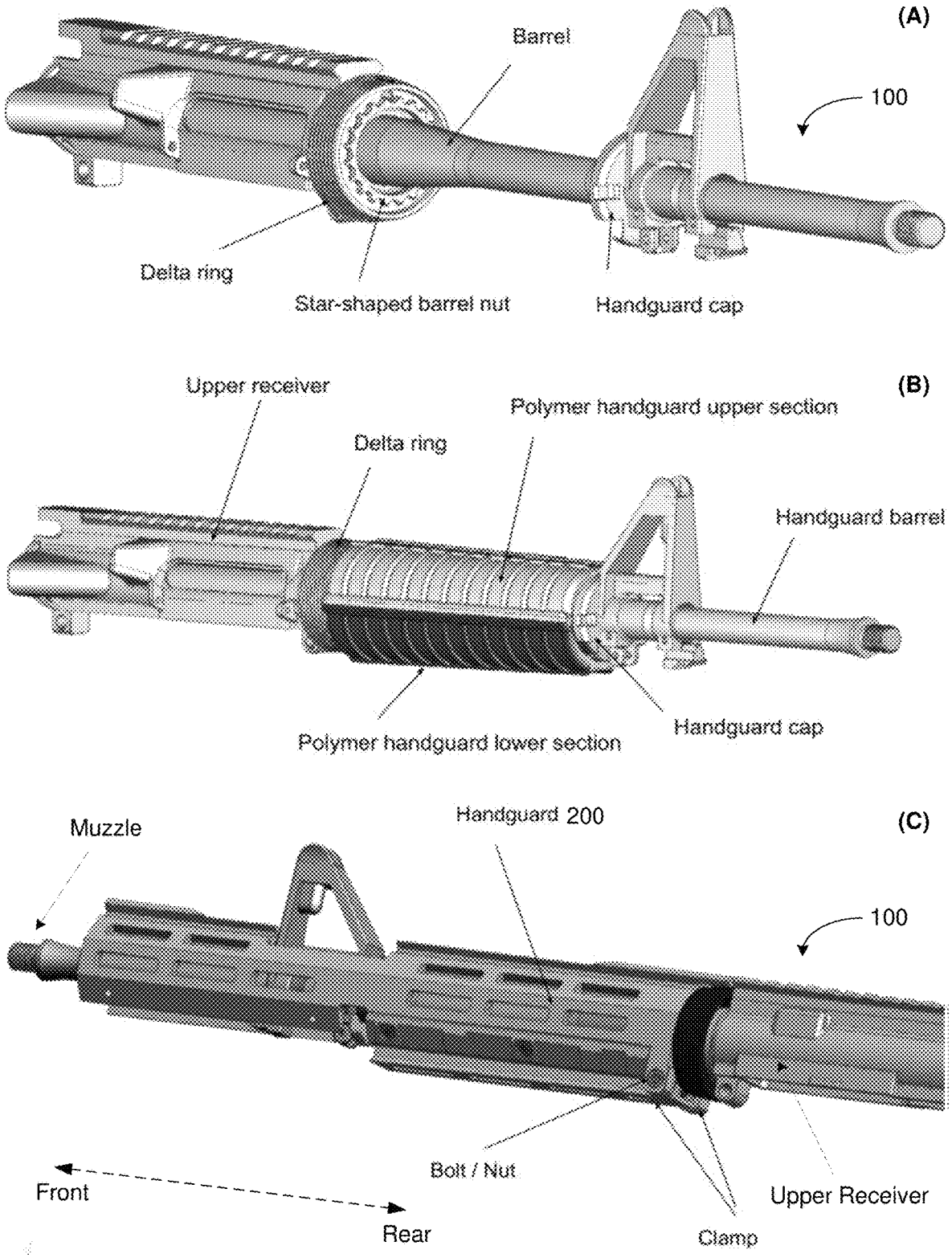
FIG. 1 is a diagram of an example firearm with a device under a proposed scheme in accordance with the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g., 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Under various proposed schemes in accordance with the present disclosure, a handguard may be mounted or otherwise installed on an AR-15 style firearm with the firearm's original delta ring, weld spring and star-shaped barrel nut. The handguard may include two main pieces, namely an upper section and a lower section. The handguard may also have a clamping mechanism configured to clamp the upper and lower sections together when the handguard is mounted/installed on the firearm. For instance, the clamping mechanism may include a nut and bolt. Tightening of the nut and bolt may ensure that the handguard is secured onto the star-shaped barrel nut, thereby preventing rotation (e.g., axially around the barrel of the firearm) and longitudinal movement (e.g., back and forth along the barrel of the firearm) of the handguard relative to the barrel or the firearm as a whole. Moreover, the handguard may further include an alignment index that may be utilized to reinforce the structure.

FIG. 1 illustrates an example firearm 100 with a device under a proposed scheme in accordance with the present disclosure. In various implementations, firearm 100 may be an AR-15 style firearm (which may be a rifle, carbine, shotgun or pistol) or any variation thereof (e.g., AR-10, M4, M16A2, and the like). Part (A) of FIG. 1 shows a perspective view of a front portion of firearm 100 with its handguard removed so as to expose certain components of firearm 100 such as, for example, an upper receiver, a delta ring, a star-shaped barrel nut, a barrel, and a handguard cap. Part (B) of FIG. 1 shows a perspective view of a front portion of firearm 100 with a conventional handguard, which is made of polymer and includes an upper section and a lower section. Part (C) of FIG. 1 shows another perspective view of the front portion of firearm 100 with a handguard 200 under a proposed scheme in accordance with the present disclosure. Handguard 200 may be secured onto firearm 100 with the aid of a clamping mechanism, or clamp, which may include a nut and a bolt in one example implementation. In some implementations, handguard 200 may be made of metal such as, for example, aluminum, another type of metal, or a metal alloy. Notably, handguard 200 may be installed or otherwise mounted on firearm 100 without removing any other components (other than the preexisting polymer handguard as the very purpose of handguard 200 is to replace the conventional polymer handguard). As shown in part (C) of FIG. 1, when installed on firearm 100, handguard 200 may shroud or otherwise surround at least a portion of the barrel of firearm 100 with the front sight post or iron sight post exposed. Handguard 200 may have a front distal end and a rear distal end such that, when handguard 200 is installed on firearm 200, the front distal end may point forwardly in a direction of the muzzle of firearm 100 while the rear distal end may point rearwardly toward an upper receiver of firearm 100.

Figure 2:
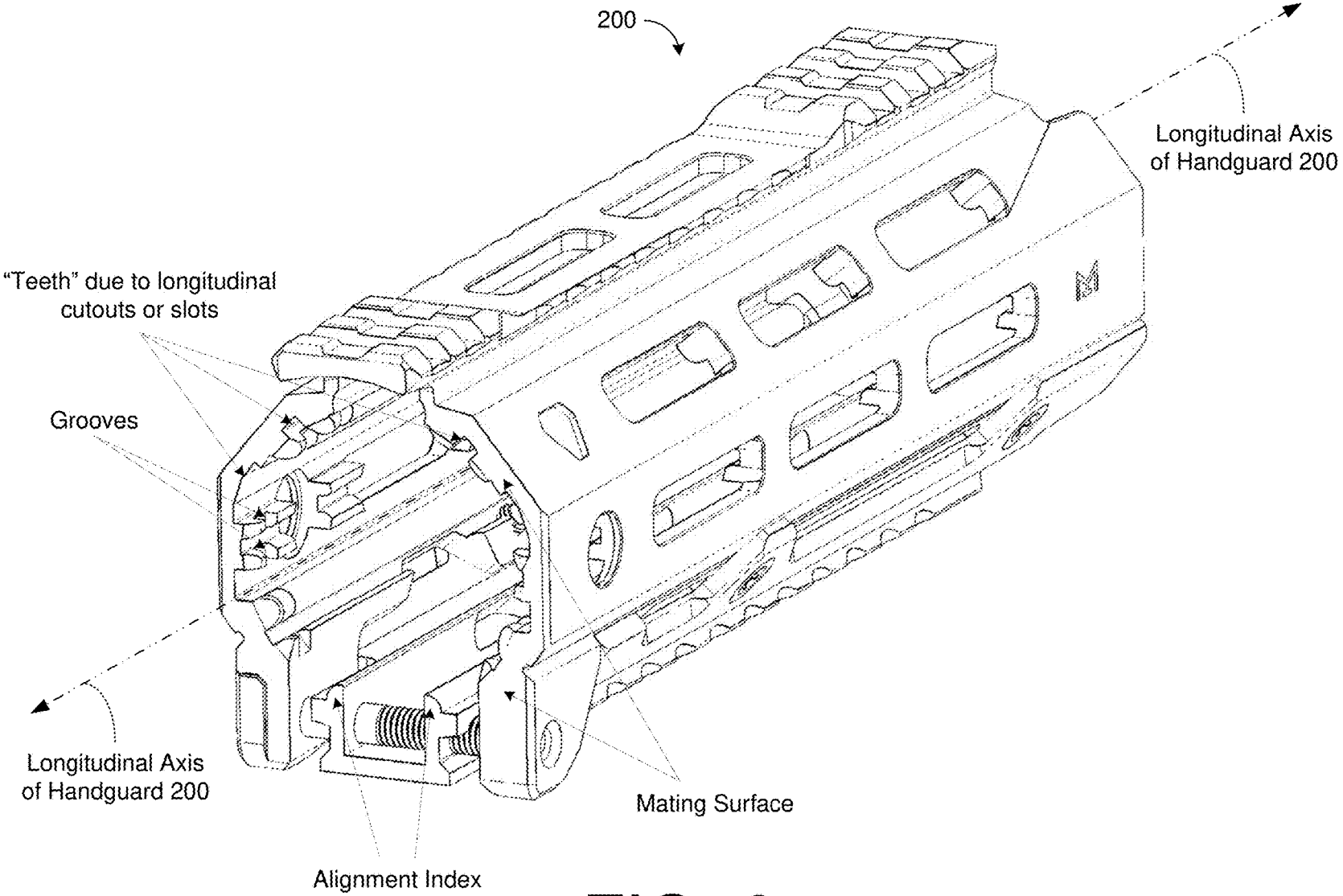
FIG. 2 is a diagram of an example device under a proposed scheme in accordance with the present disclosure.
Figure 3:
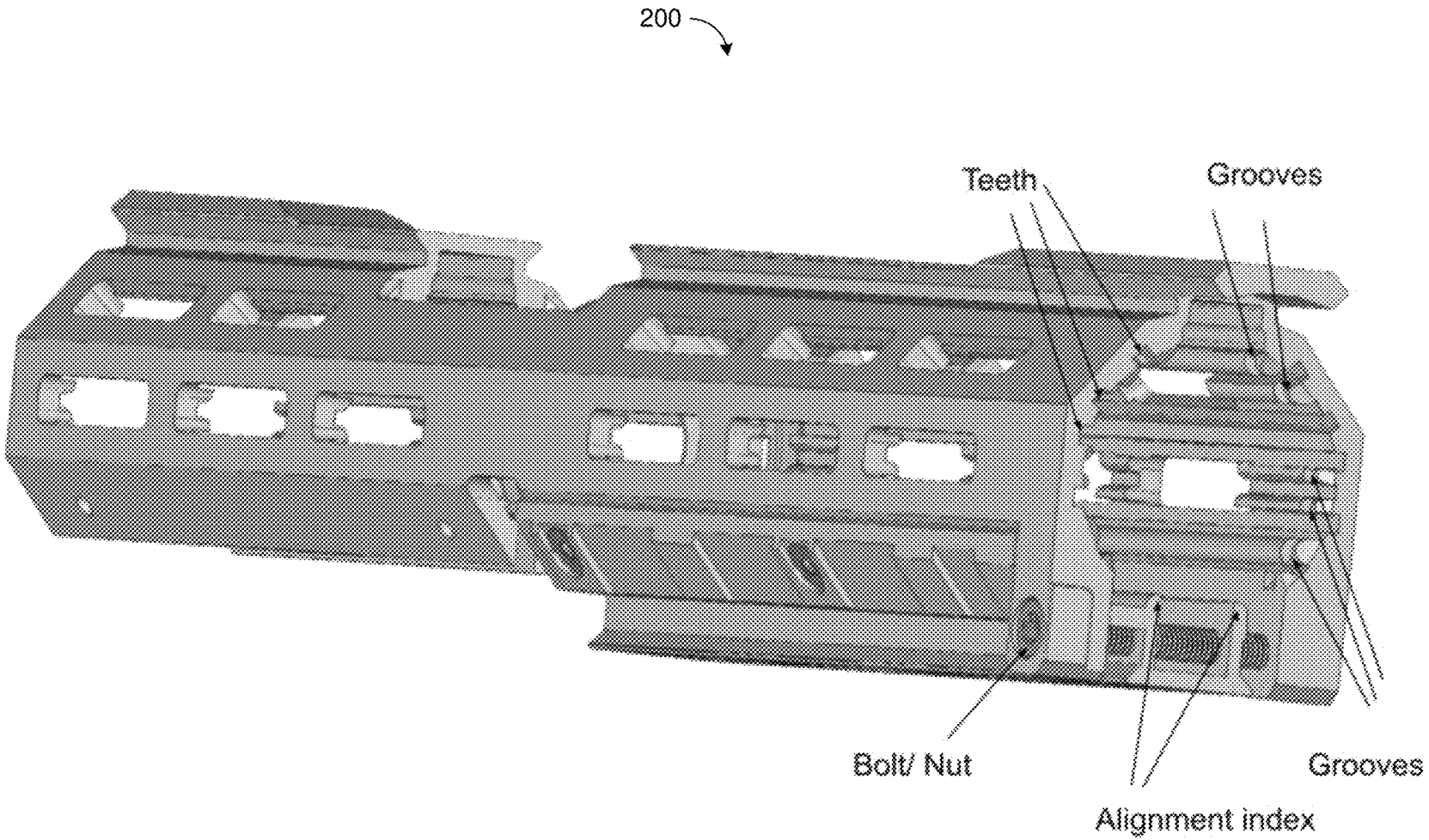
FIG. 3 is a diagram of an example device under a proposed scheme in accordance with the present disclosure.

FIG. 2 and FIG. 3 each illustrates a respective view of an example device including handguard 200 under a proposed scheme in accordance with the present disclosure. Referring to FIG. 2 and FIG. 3, on the rear distal end of handguard 200, which faces or otherwise comes in contact with the star-shaped barrel nut and delta ring of firearm 100, the contour of the internal surface of handguard 200 resembles teeth of an internal ring gear. That is, the internal surface of the rear distal end of handguard 200 may have longitudinal slots that render at least a portion of the internal surface of handguard 200 on the rear distal end to resemble the teeth of an internal ring gear. The longitudinal slots are in a direction parallel to a longitudinal axis of handguard 200 (as well as the barrel of firearm 100 when handguard 200 is installed or otherwise mounted on firearm 100). In addition, a certain distance inward from the rear distal end of handguard 200, the ridge of each of the teeth may be grooved or cut to result in grooves on the ridge of some of the teeth (e.g., by being cut or grooved radially by a lathe). That is, the grooves may be on a ridge of each of at least some of the teeth at a predefined distance from a mating surface at the rear distal end of handguard 200. When handguard 200 is installed or otherwise mounted on firearm 100, the mating surface comes in contact with the delta ring of firearm 100.

Figure 4:
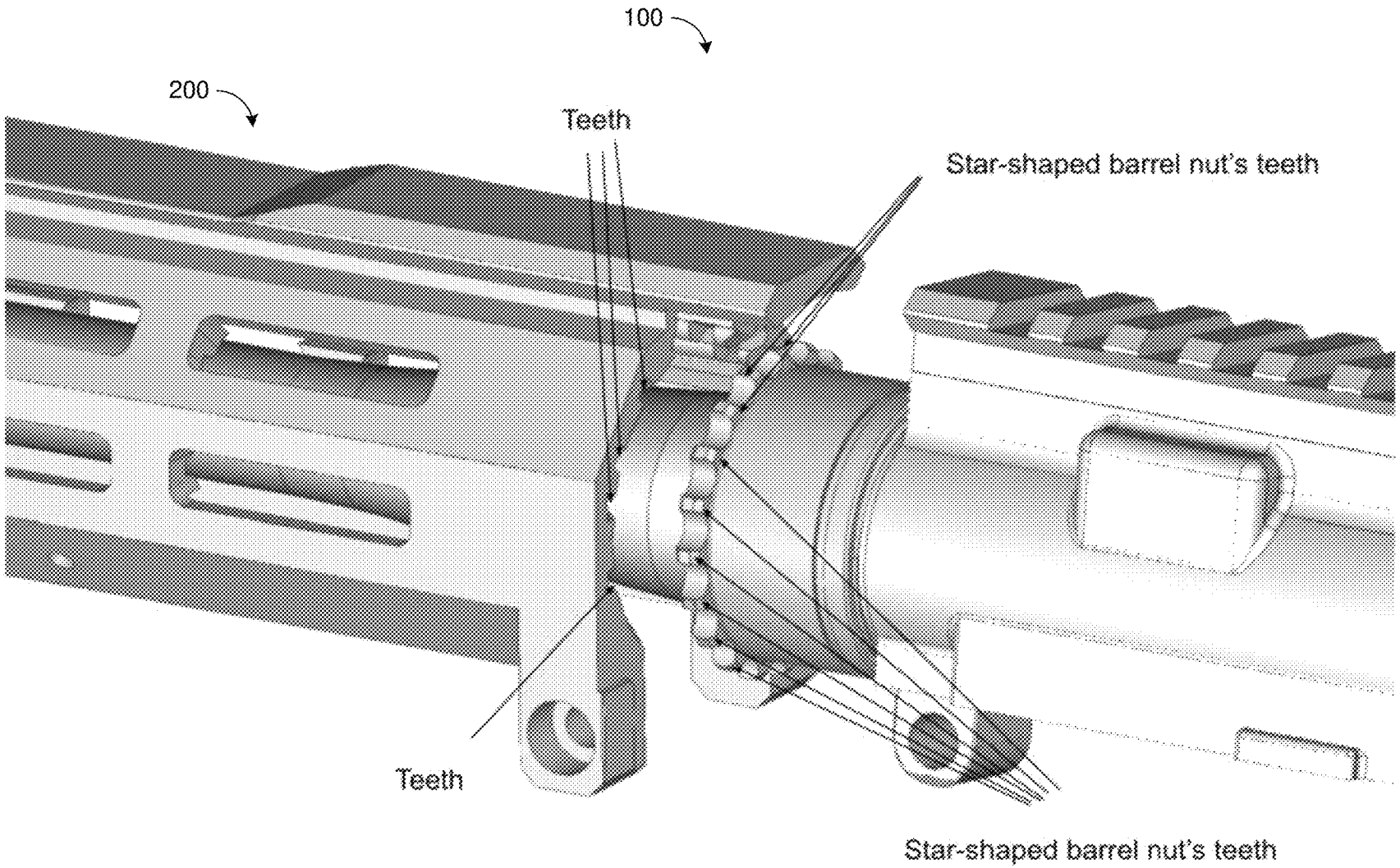
FIG. 4 is a diagram of an example firearm with a device under a proposed scheme in accordance with the present disclosure.

FIG. 4 illustrates an example firearm 100 with a device including handguard 200 under a proposed scheme in accordance with the present disclosure. During installation or mounting of handguard 200 onto firearm 100, in order to slide handguard 200 along the barrel of firearm 100 and onto the star-shaped barrel nut, a user may turn or otherwise rotate handguard 200 in one direction, clockwise or counterclockwise (e.g., axially around the barrel), by a certain degrees so that the teeth on the rear distal end of handguard 200 can slide through. The teeth on the internal surface of the rear distal end of handguard 200 allow teeth of the star-shaped barrel nut to enter and slide through the longitudinal slots as the user slides handguard 200 towards the delta ring and upper receiver of firearm 100 until some of the teeth of the star-shaped barrel nut are aligned with the grooves. Then, the user may rotate handguard 200 back in an opposite direction, counterclockwise or clockwise (e.g., axially around the barrel), by the certain degrees (e.g., so that handguard 200 is upright with respect to firearm 100) so that the star-shaped barrel nut's teeth remain inside the grooves to interlock or otherwise secure handguard 200 onto firearm 100 (e.g., handguard 200 cannot move in a longitudinal direction forward or backward with respect to firearm 100).

In some implementations, handguard 200 may also be equipped with an optional alignment index piece, as shown in FIG. 2 and FIG. 3. After the aforementioned steps of installation of handguard 200 onto firearm 100 with rotation in a first direction, sliding, and rotation in a second direction opposite the first direction, the alignment index piece may be inserted (e.g., into an opening on the bottom side of handguard 200) to touch some of the star-shaped barrel nut's teeth to reinforce the structure of handguard 200 when the clamping mechanism is tightened. Then, the clamping mechanism may be tightened (e.g., with a nut and a bolt) to secure handguard 200 onto the teeth of the star-shaped barrel nut. That is, the clamping mechanism may be configured to exert a clamping force to aid in securing handguard 200 to firearm 100 when the clamping mechanism is tightened (e.g., by turning either or both of the nut and bolt in appropriate direction(s)).

Example Implementations

In view of the above, the proposed designs of a firearm handguard may be implemented in many ways. For illustrative purposes and without limiting the scope of the present disclosure, a few example implementations of the proposed design are described below.

In one aspect, a device implementable on a firearm (e.g., an AR-15 style firearm) may include a handguard. When the handguard is installed on the firearm: (a) the handguard is configured to surround at least a portion of a barrel of the firearm; (b) the handguard has a first distal end and a second distal end opposite the first distal end such that the first distal end points in a direction of a muzzle of the firearm and the second distal end points toward an upper receiver of the firearm; and (c) the second distal end is configured with physical features that interlock with a star-shaped barrel nut of the firearm to secure the handguard onto the firearm.

In some implementations, the physical features may include: (1) longitudinal slots on an internal surface of the handguard near the second distal end thereof such that a contour of the internal surface of the handguard at the second distal end resembles teeth of an internal ring gear; and (2) grooves on a ridge of at least some of the teeth at a predefined distance from a mating surface at the second distal end of the handguard which contacts a delta ring of the firearm when the handguard is installed on the firearm.

In some implementations, the physical features may be configured such that, during installation of the handguard on the firearm: (i) the handguard is rotated by a predefined amount in a first direction and then is slid rearwardly along a barrel of the firearm toward the upper receiver of the firearm to allow teeth of a star-shaped barrel nut of the firearm to enter and slide through the longitudinal slots until some of the teeth of the star-shaped barrel nut are aligned with the grooves; and (ii) the handguard is then rotated by the predefined amount in a second direction opposite the first direction so that the teeth of the star-shaped barrel nut remain inside the grooves to secure the handguard onto the firearm.

In some implementations, the physical features may also include a clamping mechanism configured to exert a clamping force to aid in securing the handguard to the firearm when tightened. In some implementations, the clamping mechanism may include a nut and a bolt.

In some implementations, the physical features may further include an alignment index piece insertable in an opening on a bottom side of the handguard, the alignment index piece configured with one or more alignment indexes touching one or more of teeth of a star-shaped barrel nut of the firearm to result in structural reinforcement when the alignment index piece is inserted in the opening and the clamping mechanism is tightened.

In some implementations, the handguard may be made of metal or metal alloy. In some implementations, the handguard may be made of aluminum.

In another aspect, an apparatus implementable on a firearm (e.g., an AR-15 style firearm) may include a handguard and at least a portion of the firearm, including a barrel, a star-shaped barrel nut, a delta ring, and an upper receiver. When the handguard is installed on the firearm: (a) the handguard is configured to surround at least a portion of the barrel; (b) the handguard has a first distal end and a second distal end opposite the first distal end such that the first distal end points in a direction of a muzzle of the firearm and the second distal end points toward the upper receiver; and (c) the second distal end is configured with physical features that interlock with a star-shaped barrel nut of the firearm to secure the handguard onto the firearm.

In some implementations, the physical features may include: (1) longitudinal slots on an internal surface of the handguard near the second distal end thereof such that a contour of the internal surface of the handguard at the second distal end resembles teeth of an internal ring gear; and (2) grooves on a ridge of at least some of the teeth at a predefined distance from a mating surface at the second distal end of the handguard which contacts the delta ring when the handguard is installed on the firearm.

In some implementations, the physical features may be configured such that, during installation of the handguard on the firearm: (i) the handguard is rotated by a predefined amount in a first direction and then is slid rearwardly along the barrel toward the upper receiver to allow teeth of the star-shaped barrel nut to enter and slide through the longitudinal slots until some of the teeth of the star-shaped barrel nut are aligned with the grooves; and (ii) the handguard is then rotated by the predefined amount in a second direction opposite the first direction so that the teeth of the star-shaped barrel nut remain inside the grooves to secure the handguard onto the firearm.

In some implementations, the physical features may also include a clamping mechanism configured to exert a clamping force to aid in securing the handguard to the firearm when tightened. In some implementations, the clamping mechanism may include a nut and a bolt.

In some implementations, the physical features may further include an alignment index piece insertable in an opening on a bottom side of the handguard, the alignment index piece configured with one or more alignment indexes touching one or more of teeth of the star-shaped barrel nut to result in structural reinforcement when the alignment index piece is inserted in the opening and the clamping mechanism is tightened.

In some implementations, the handguard may be made of metal or metal alloy. In some implementations, the handguard may be made of aluminum.

ADDITIONAL NOTES

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a handguard, wherein, when the handguard is installed on the firearm:

the handguard is configured to surround at least a portion of a barrel of the firearm;

the handguard has a first distal end and a second distal end opposite the first distal end such that the first distal end points in a direction of a muzzle of the firearm and the second distal end points toward an upper receiver of the firearm; and the second distal end is configured with physical features that interlock with a star-shaped barrel nut of the firearm to secure the handguard onto the firearm, wherein the physical features comprise:

longitudinal slots on an internal surface of the handguard near the second distal end thereof such that a contour of the internal surface of the handguard at the second distal end resembles teeth of an internal ring gear; and grooves on a ridge of at least some of the teeth at a predefined distance from a mating surface at the second distal end of the handguard which contacts a delta ring of the firearm when the handguard is installed on the firearm, wherein the physical features are configured such that, during installation of the handguard on the firearm:

the handguard is rotated by a predefined amount in a first direction and then is slid rearwardly along a barrel of the firearm toward the upper receiver of the firearm to allow teeth of a star-shaped barrel nut of the firearm to enter and slide through the longitudinal slots until some of the teeth of the star-shaped barrel nut are aligned with the grooves; and the handguard is then rotated by the predefined amount in a second direction opposite the first direction so that the teeth of the star-shaped barrel nut remain inside the grooves to secure the handguard onto the firearm.

2. The device of claim 1, wherein the physical features further comprise:

a clamping mechanism configured to exert a clamping force to aid in securing the handguard to the firearm when tightened.

3. The device of claim 2, wherein the clamping mechanism comprises a nut and a bolt.

4. The device of claim 2, wherein the physical features further comprise:

an alignment index piece insertable in an opening on a bottom side of the handguard, the alignment index piece configured with one or more alignment indexes touching one or more of teeth of a star-shaped barrel nut of the firearm to result in structural reinforcement when the alignment index piece is inserted in the opening and the clamping mechanism is tightened.

5. The device of claim 1, wherein the handguard is made of metal or metal alloy.

6. The device of claim 1, wherein the handguard is made of aluminum.

7. An apparatus implementable on a firearm, comprising:

at least a portion of the firearm comprising a barrel, a star-shaped barrel nut, a delta ring, and an upper receiver; and a handguard, wherein, when the handguard is installed on the firearm:

the handguard is configured to surround at least a portion of the barrel;

the handguard has a first distal end and a second distal end opposite the first distal end such that the first distal end points in a direction of a muzzle of the firearm and the second distal end points toward the upper receiver; and the second distal end is configured with physical features that interlock with a star-shaped barrel nut of the firearm to secure the handguard onto the firearm, wherein the physical features comprise:

longitudinal slots on an internal surface of the handguard near the second distal end thereof such that a contour of the internal surface of the handguard at the second distal end resembles teeth of an internal ring gear; and grooves on a ridge of at least some of the teeth at a predefined distance from a mating surface at the second distal end of the handguard which contacts the delta ring when the handguard is installed on the firearm, wherein the physical features are configured such that, during installation of the handguard on the firearm:

the handguard is rotated by a predefined amount in a first direction and then is slid rearwardly along the barrel toward the upper receiver to allow teeth of the star-shaped barrel nut to enter and slide through the longitudinal slots until some of the teeth of the star-shaped barrel nut are aligned with the grooves; and the handguard is then rotated by the predefined amount in a second direction opposite the first direction so that the teeth of the star-shaped barrel nut remain inside the grooves to secure the handguard onto the firearm.

8. The apparatus of claim 7, wherein the physical features further comprise:

a clamping mechanism configured to exert a clamping force to aid in securing the handguard to the firearm when tightened.

9. The apparatus of claim 8, wherein the clamping mechanism comprises a nut and a bolt.

10. The apparatus of claim 8, wherein the physical features further comprise:

an alignment index piece insertable in an opening on a bottom side of the handguard, the alignment index piece configured with one or more alignment indexes touching one or more of teeth of the star-shaped barrel nut to result in structural reinforcement when the alignment index piece is inserted in the opening and the clamping mechanism is tightened.

11. The apparatus of claim 7, wherein the handguard is made of metal or metal alloy.

12. The apparatus of claim 7, wherein the handguard is made of aluminum.

13. A device implementable on a firearm, comprising:

a handguard, wherein, when the handguard is installed on the firearm:

the handguard is configured to surround at least a portion of a barrel of the firearm;

the handguard has a first distal end and a second distal end opposite the first distal end such that the first distal end points in a direction of a muzzle of the firearm and the second distal end points toward an upper receiver of the firearm; and the second distal end is configured with physical features that interlock with a star-shaped barrel nut of the firearm to secure the handguard onto the firearm, wherein the physical features comprise:

longitudinal slots on an internal surface of the handguard near the second distal end thereof such that a contour of the internal surface of the handguard at the second distal end resembles teeth of an internal ring gear;

grooves on a ridge of at least some of the teeth at a predefined distance from a mating surface at the second distal end of the handguard which contacts a delta ring of the firearm when the handguard is installed on the firearm;

a clamping mechanism configured to exert a clamping force to aid in securing the handguard to the firearm when tightened; and an alignment index piece insertable in an opening on a bottom side of the handguard, the alignment index piece configured with one or more alignment indexes touching one or more of teeth of a star-shaped barrel nut of the firearm to result in structural reinforcement when the alignment index piece is inserted in the opening and the clamping mechanism is tightened.

14. The device of claim 13, wherein the clamping mechanism comprises a nut and a bolt.

15. The device of claim 13, wherein the handguard is made of metal or metal alloy.

16. The device of claim 13, wherein the handguard is made of aluminum.

* * * * *